United States Patent [19]

Focke

[11] 4,251,022

[45] Feb. 17, 1981

[54] PACK, IN PARTICULAR CUBOID CIGARETTE PACK

[75] Inventor: Heinz Focke, Verden, Fed. Rep. of Germany

[73] Assignee: Focke & Co., Verden, Fed. Rep. of Germany

[21] Appl. No.: 74,030

[22] Filed: Sep. 10, 1979

[30] Foreign Application Priority Data

Oct. 12, 1978 [DE] Fed. Rep. of Germany ..... 2844444

[51] Int. Cl.[3] ..... B65D 5/34

[52] U.S. Cl. ..... 229/44 CB; 493/56; 493/355

[58] Field of Search ..... 229/44 CB, 45

[56] References Cited

U.S. PATENT DOCUMENTS

| | | | |
|---|---|---|---|
| 3,163,348 | 12/1964 | Schmerund | 229/44 CB |
| 3,944,066 | 3/1976 | Niepmann | 229/4 CB |
| 3,979,047 | 9/1976 | Focke et al. | 229/44 CB |

FOREIGN PATENT DOCUMENTS

| | | | |
|---|---|---|---|
| 819206 | 9/1959 | United Kingdom | 229/44 CB |

*Primary Examiner*—Davis T. Moorhead

*Attorney, Agent, or Firm*—Sughrue, Rothwell, Mion, Zinn and Macpeak

[57] ABSTRACT

The invention relates to a pack, in particular a cuboid cigarette pack, of stiff paper, cardboard or the like, with several flaps of differing transverse and/or longitudinal size which are folded over one another in layers and may or may not be bonded to one another.

9 Claims, 6 Drawing Figures

PACK, IN PARTICULAR CUBOID CIGARETTE PACK

BACKGROUND OF THE INVENTION

In packs made from material of a certain stiffness, for example hinged-lid boxes for cigarettes and the like, constructions result which require that certain flaps, forming a common wall of the pack, must necessarily be constructed with different sizes, in particular with different transverse sizes. This applies in particular to inner flaps which, when they extend over the full width of the wall in question, must have a width diminished by the thickness of the wall located at right angles thereto, if the flaps are not to be forced, buckled or the like.

An example of the above problem is provided by the pack according to our earlier German Patent Application No. P 28 13 390.6. The pack described therein, of the hinged-lid box type, consists of a uniform, single blank, including a collar customary in such packs, the collar consisting of a collar front wall and collar side flaps. This collar is set back inwards relative to the front wall of the pack and relative to the side walls thereof. The collar flaps therefore rest against the inner face of the side wall of the pack. This means that the free contact surface for the collar flaps is of lesser width than the (outer) transverse sizes of the side wall. This side wall is usually formed from two side flaps having the width of the pack side wall, which are folded over one another and bonded to one another. Consequently, the collar flaps must have a smaller width than the abovementioned side flaps.

A further example of such a pack is provided by German Offenlegungsschrift No. 2,332,438. Here, not only the collar flaps but further gores, belonging to the inner side flaps, must be constructed of a lesser width than the side flaps in question.

This leads to difficulties in the production of the blanks for such packs. If the integral, spread-flat blanks are cut lying next to one another from one sheet, for example a punched sheet, a continuous web or the like, it is not possible to arrange the blanks to lie closely next to one another and sever them, at least in the region of the side flaps of equal width, by a common, single severing cut. Simultaneous production of the relevant flaps of lesser width by also severing a very narrow edge strip of 1 mm or 2 mm width is technically not feasible. Rather, it is necessary in such a case to punch out an intermediate strip of at least 3 mm width extending over the entire length of the blank. This is technically difficult and moreover leads to increased material consumption. Furthermore, it is a disadvantage that as a result of the punching a substantial amount of waste is always produced, which must be removed.

SUMMARY OF THE INVENTION

Starting from this situation, it is the object of the invention to construct packs of very diverse types, but in particular hinged-lid boxes for cigarettes or the like, in such a way that the blanks, with flaps of different width arranged in sequence, nevertheless lie closely next to one another and can be severed from one sheet by a common, single severing cut.

To achieve this object, the invention provides a pack wherein all the flaps concerned are constructed with the same width and/or length and any lesser size of certain flaps required by the construction of the pack is achieved by permanent deformation of these resulting from embossing or the like. This moulding causes a shortening of the relevant flaps to the required extent.

According to a further characteristic of the invention, the permanent deformations may be corrugations, grooves and the like, or may consist of beading of a free edge, or of creping.

Preferably, the invention is applied to a hinged-lid box with integral collar, where side flaps of the collar are located on the inner face of the pack or between side flaps of the side wall. In this case, the collar flap is initially formed in the same width as the adjoining side flaps, but its effective size is reduced by the moulding according to the invention. Bottom corner flaps and lid corner flaps can be constructed similarly in such a pack.

According to the process of the invention for the production of blanks for packs of the abovementioned type, the blanks are so arranged within the sheet (from which they are produced) that the side flaps, including the collar flaps, of adjacent blanks are divided from one another by a common severing cut and the collar flaps and, where appropriate, the bottom corner flaps and/or lid corner flaps, are provided with a permanent deformation which reduces their width. The blanks can then each be severed off by a single severing cut, without producing waste.

BRIEF DESCRIPTION OF THE DRAWINGS

The invention is explained below in more detail in relation to an illustrative embodiment, namely a hinged-lid box for cigarettes or the like. In the drawings.

DETAILED DESCRIPTION OF PREFERRED EMBODIMENTS

The problem discussed so far applies to packs of all kinds made from a material of relatively stable shape, in particular cardboard, carton and the like. The field of application touched on above is cuboid packs for cigarettes and the like, and in particular so-called hinged-lid boxes.

Figure 1:
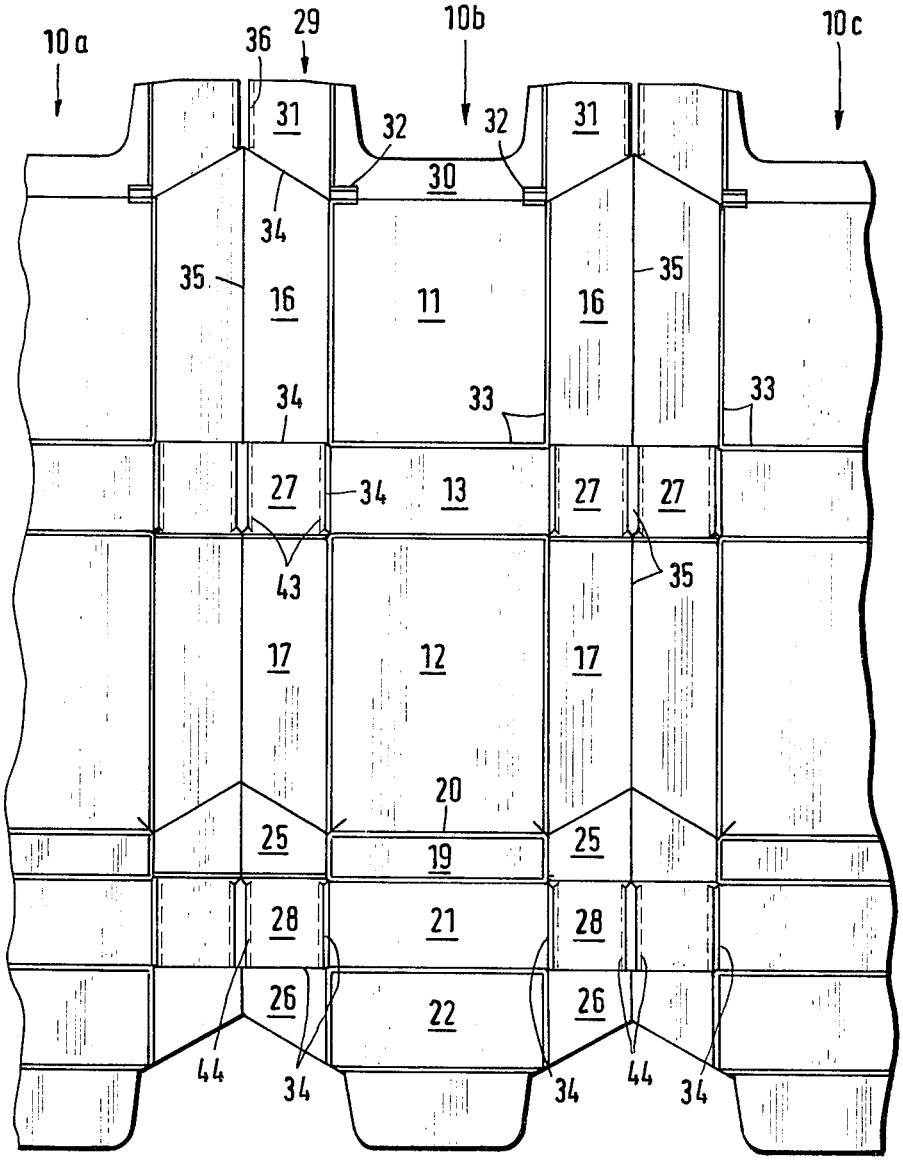
FIG. 1 shows spread-out blanks with side flaps of different widths within a sheet (web or the like) of the packaging material.
Figure 2:
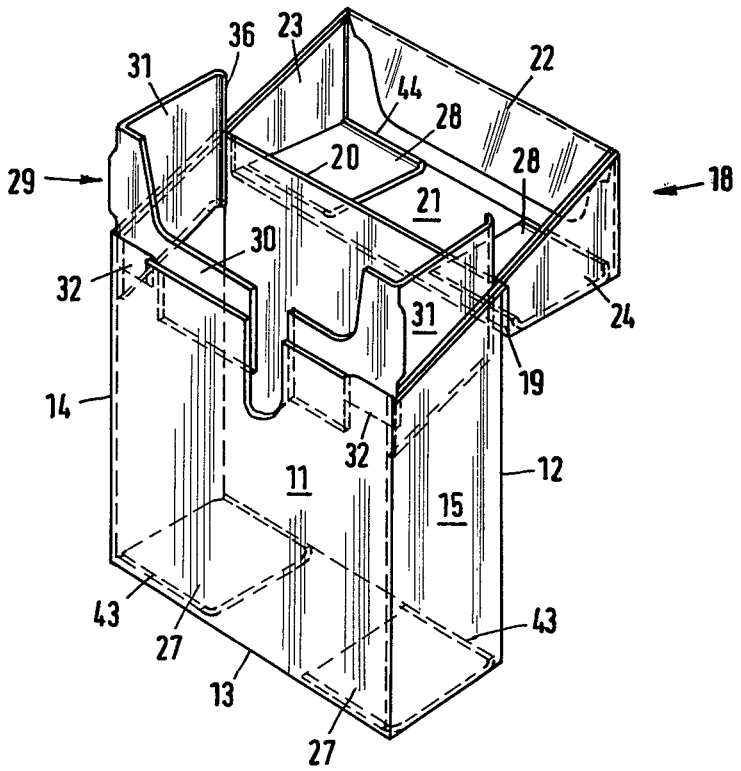
FIG. 2 shows a hinged-lid box possessing the characteristics of German Patent Application No. P 28 12 390.6 in perspective view.

In FIG. 1, blanks 10*a*, 10*b*, 10*c* are shown arranged tightly against one another within a web or a sheet of thin carton for the manufacture of hinged-lid boxes of the type shown in FIG. 2, that is to say essentially having the characteristics of our earlier German Patent Application No. P 28 13 390.6. The blanks form individual areas delimited from one another, which areas correspond to a front wall 11, a rear wall 12, a bottom 13 and side walls 14 and 15 of the pack according to FIG. 2. The side walls are each formed from two side flaps 16 and 17, which are folded over one another to the extent of their full area and substantially extend over the entire width and height of the side walls 14 and 15.

A pivotable lid 18 adjoins the upper edge of the rear wall 12. The rear wall 19 of this lid is integrally joined to the rear wall 12 along a folding axis 20.

The lid 18 additionally consists of the lid upper wall 21, the lid front wall 22 and the lid side walls 23, 24. The latter are formed from lid side flaps 25, 26 which matchingly lie over one another.

The (inner) side flaps 16 are each joined to bottom corner flaps 27 which, in the finished pack, are folded to lie in the plane of the bottom 13. Analogously, the inner lid side flaps 25 are provided with lid corner flaps 28 which are also folded to lie in the plane of the lid upper wall 21.

A collar 29 customary in such types of packs and consisting of a collar front wall 30 and collar flaps 31 is integrally joined to the blank 10*a*, 10*b*, 10*c* so far described, in particular via residual connections 32 in the sense of German Patent Application No. P 28 13 390.6.

In the drawing in FIG. 1, single lines indicate severing cuts whilst double lines show embossed ridges 33, customary with such packs because of the stiffness of the material, which define the folding edges. It may be seen from this that the collar flaps 31 are divided from the side flaps 16, the bottom corner flaps 27, from the side walls 15 and the bottom 13, and the lid corner flaps 28 from the lid upper wall 21 and the outer lid side flaps 26, by severing cuts 34.

The pack according to FIG. 2, produced from a single blank 10*a* or 10*b* of this type can, as shown here, be constructed in such a way that the collar flaps 31 rest against the inside of the side walls 14, 15 and may or may not be joined thereto. Because of the geometrical relationships, the free internal size of the side walls 14, 15 is less than the external size thereof and less than the width of the side flaps 16 and 17 from which the side walls 14 and 15 are formed. In order that there should be no buckling inside the pack, the collar flaps 31 must logically be of lesser width than the side flaps 16 and 17.

However, from the point of view of the production technology, it is desirable that, as shown in FIG. 1, it should be possible to produce the blanks, located adjoining one another over their full length, by a single common severing cut 35. As a result of this cut, the collar flaps 31 are originally made of the same width as the side flaps 16 and 17. In order nevertheless to take account of the reduced transverse dimensions the collar flaps 31 are provided with permanent deformations, embossings or the like, which lead to an effective reduction in width.

Figure 4:
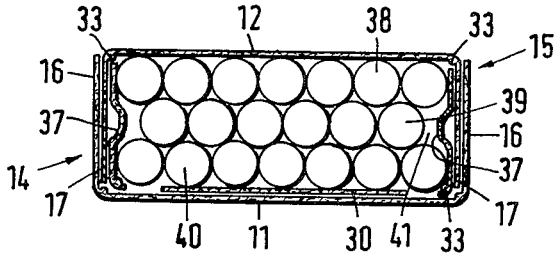
FIG. 4 shows another embodiment of a detail of the pack, in a horizontal cross-section corresponding to FIG. 3.
Figure 3:
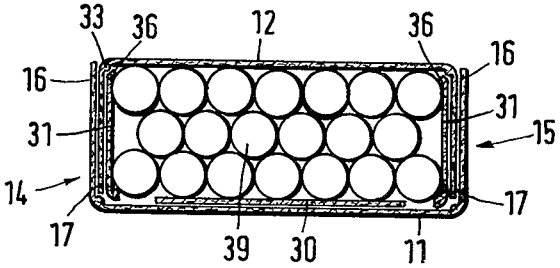
FIG. 3 shows a horizontal cross-section of the pack according to FIG. 2, at the level of the collar thereof, with the lid opened.

In the illustrative embodiment of FIG. 1, and correspondingly in FIG. 3 the free side edges of the collar flaps 31 are provided with an arc-shaped beading 36. This leads to a corresponding reduction in width. Inside the pack, the resulting inward-pointing edge of the collar flaps 31 are not objectionable (FIG. 4).

Alternatively, a deformation can be provided at a distance from the edge of the collar flaps 31. According to FIG. 4, a gutter-shaped recess 37 is moulded into approximately the middle zone of the collar flap 31. This recess can advantageously be employed with cigarette packs which, as shown in FIG. 4, are filled with cigarettes arranged in three rows 38, 39, 40 in such a way that the cigarettes in the middle row 39 leave a gap relative to those of the outer rows 38, 40. This produces a gap 41 in the edge zone, in the zone of which gap is provided the recess 37.

Figure 5:
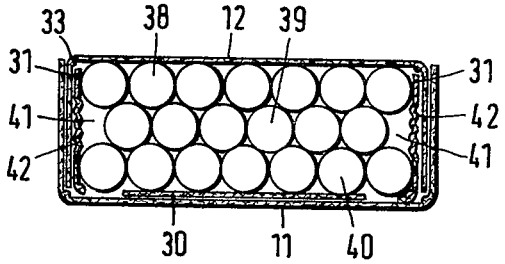
FIG. 5 shows a further illustrative embodiment of the invention.

The illustrative embodiment according to FIG. 5 is of similar construction. Here, small corrugations in the nature of a creping 42 are provided in the middle zone.

Figure 6:
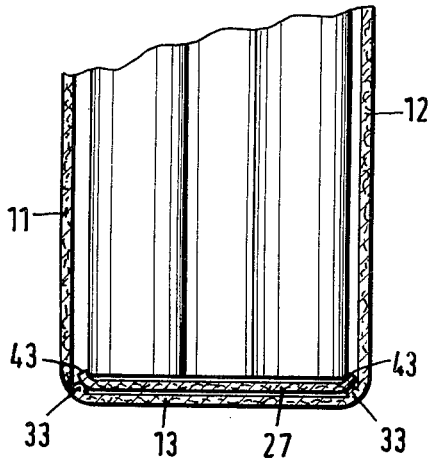
FIG. 6 shows a vertical cross-section in the region of the bottom and of a corner flap thereof, relating to the pack according to FIG. 2.

The "flap shortening" described above can also be of importance for other flaps of the blank 10*a*, 10*b* or the like. In the present illustrative embodiment, the bottom corner flaps 27 and the lid corner flaps 28 are provided, at the two opposite free edges, with a deformation in the sense of a beading 43, 44. In the finished folded pack (see in particular FIG. 6) the bottom corner flap 27, which is intrinsically of the full width, can as a result rest flat on the bottom 13. The reduction in cross-section which is naturally present in this zone as a result of the moulded-in embossed ridges 33 is compensated by the said beadings 43, 44. Analogously, the lid corner flaps 28 can rest over their full area against the inside of the lid upper wall 21.

The blanks 10*a*, 10*b*, 10*c* are, as may be seen from FIG. 1, produced without waste by a common severing cut 35. Advantageously, the severing or punching tool is so constructed that the embossings, that is to say in the present case the beadings 36, 43, 44, are provided simultaneously with the requisite severing cuts, so that a ready-to-process blank is obtained in one working step.

I claim:

1. A pack, especially a cuboid cigarette pack, of stiff paper, cardboard or the like, with flaps of differing transverse and/or longitudinal size, which flaps are folded over one another in several layers and may or may not be bonded to one another, wherein all the flaps concerned (16, 17; 25, 26; 27, 28; 31) are constructed of the same width and/or length and any lesser size of certain flaps (27, 28, 31) required by the construction of the pack is achieved by permanent moulding of these resulting from embossing or the like.

2. A pack, according to claim 1, wherein the lesser size results from the moulding-in of corrugations, grooves, beads (36, 43, 44) or recesses (37) or from creping (42).

3. A pack according to claim 2, wherein the flaps (27, 28, 31) are provided with a beading (36, 43, 44) at their free edge.

4. A pack according to claim 1 or 2, wherein the flaps are provided, in their middle zone, with at least one moulded-in corrugation or recess (37) or with several flat grooves which constitute creping (42).

5. A pack according to claim 4, wherein inner upright flaps (collar flaps 31) of a cigarette pack comprising three rows (38, 39, 40) of cigarettes and gaps (41) in the zone of the middle row (39), namely at the edge of this row, are provided with the relevant deformations (recess 37, creping 42 or the like) in the zone of the gap (41).

6. A pack according to any of claims 1–3 and 5, wherein, in the case of a hinged-lid box with an inner collar flap (31), the latter is provided with deformations according to one of the preceding claims.

7. A pack according to any of claims 1–3 and 5, wherein bottom corner flaps (27) and/or lid corner flaps (28) are provided with deformations which reduce the width of the said flaps, in particular with bleeding (43, 44) on either side.

8. A process for the manufacture of blanks for packs according to any of claims 1–3 and 5, especially blanks for hinged-lid boxes with side flaps, lid side flaps, bottom corner flaps, lid corner flaps and collar flaps, in which blanks can be produced successively, or in positions next to one another by severing cuts from one sheet, wherein the side flaps (16, 17) including the lid side flaps (25, 26) and/or collar flaps (31) and/or bottom corner flaps (27) and/or lid corner flaps (28) are divided from one another by a common continuous single severing cut (35) and the collar flaps (31), bottom corner flaps (827) and lid corner flaps (28), produced in the same width, are provided with a permanent deformation which reduces their width.

9. A process according to claim 8, wherein the severing cut and the deformations are executed simultaneously.

* * * * *